US008485339B2

(12) United States Patent
Ugajin

(10) Patent No.: US 8,485,339 B2
(45) Date of Patent: Jul. 16, 2013

(54) BANKNOTE DEPOSITING AND DISPENSING MACHINE

(75) Inventor: Kazuhide Ugajin, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 220 days.

(21) Appl. No.: 13/062,283

(22) PCT Filed: Jun. 2, 2010

(86) PCT No.: PCT/JP2010/059305

§ 371 (c)(1), (2), (4) Date: Mar. 4, 2011

(87) PCT Pub. No.: WO2010/150627

PCT Pub. Date: Dec. 29, 2010

(65) Prior Publication Data

US 2011/0155540 A1 Jun. 30, 2011

(30) Foreign Application Priority Data

Jun. 24, 2009 (JP) ..... 2009-149950

(51) Int. Cl.
*G07D 9/00* (2006.01)

(52) U.S. Cl.
USPC ..... 194/351; 194/350; 312/100; 312/223.1; 198/950

(58) Field of Classification Search
USPC ..... 198/950; 194/350, 351; 312/100, 312/223.1
See application file for complete search history.

(56) References Cited

U.S. PATENT DOCUMENTS

| | | | | | |
|---|---|---|---|---|---|
| 4,473,157 | A * | 9/1984 | Hirose et al. | ..... | 209/534 |
| 4,542,287 | A * | 9/1985 | Watanabe | ..... | 235/379 |
| 4,733,765 | A * | 3/1988 | Watanabe | ..... | 194/206 |
| 5,499,805 | A * | 3/1996 | Anma | ..... | 271/3.05 |
| 6,752,367 | B2 * | 6/2004 | Yamashita et al. | ..... | 248/312 |
| 2003/0193273 | A1 * | 10/2003 | Yamashita et al. | ..... | 312/100 |
| 2004/0060980 | A1 | 4/2004 | Shibata et al. | ..... | 235/381 |

FOREIGN PATENT DOCUMENTS

| | | | |
|---|---|---|---|
| JP | 63-242839 | A | 10/1988 |
| JP | 63242839 | A * | 10/1988 |
| JP | 2003-303366 | A | 10/2003 |
| JP | 2006-058939 | A | 3/2006 |

* cited by examiner

*Primary Examiner* — Patrick Mackey
(74) *Attorney, Agent, or Firm* — Rabin & Berdo, P.C.

(57) ABSTRACT

When depositing processing is performed, a banknote guide section and a bill press are separated from each other such that a banknote accommodation space formed between the banknote guide section and the bill press is positioned below a banknote depositing and dispensing port, a upper guide section is moved towards a pickup roller side and a input port shutter is opened. After the input port shutter has been closed, the upper guide section is moved towards a bill press side, and by moving the banknote guide section and the bill press towards the pickup roller side, the pickup roller, which is projected out into the accommodation space through a cutout in the banknote guide section, and which makes contact with the banknote, feeds the banknote out towards a conveying path.

5 Claims, 7 Drawing Sheets

BANKNOTE DEPOSITING AND DISPENSING MACHINE

TECHNICAL FIELD

The present invention relates to a banknote depositing and dispensing machine provided to an automated teller machine and performing processing for depositing and dispensing banknotes.

RELATED ART

In order to deposit banknotes with a conventional banknote depositing and dispensing machine, a banknote depositing and dispensing port of a banknote depositing and dispensing section is opened by opening an input port shutter. Then, after banknotes have been introduced by a customer, the input port shutter is closed, and a pickup roller is rotated while the introduced banknotes are being pressed by a bill press against the pickup roller, thereby feeding the banknotes into the apparatus (see, for example, Patent Document 1 (Japanese Patent Application Laid-Open (JP-A) No 2006-58939 (paragraphs [0013] to [0014])).

DISCLOSURE OF THE INVENTION

Problem to be Solved by the Invention

However, with the above described conventional technology, only the bill press provided inside the banknote depositing and dispensing section is moved in the direction of the banknotes, in order to prevent damage occurring due to entry of foreign object into a gap formed between the input port shutter and the banknote depositing and dispensing section, and in order to prevent internal mechanisms being visible through a gap. Consequently, the size of the banknote depositing and dispensing section is determined by the placement of the movement mechanism of the bill press and the movement range of the bill press.

A plate shaped member is further provided in the gap present between the top of the banknote depositing and dispensing section and the casing, with this member serving to prevent any foreign object from entering through the gap between the top of the banknote depositing and dispensing section and the casing and falling into the inside of the apparatus. However, this member is formed on the large side in order to be certain that foreign objects are prevented from falling internally, resulting in the banknote depositing and dispensing section becoming bulky, with this being an issue in that it is consequently difficult to achieve a more compact banknote depositing and dispensing machine by making the banknote depositing and dispensing section smaller.

The present invention provides means to address the above issue.

Method of Solving the Problem

In order to address the above issue, the present invention is a banknote depositing and dispensing machine including a shutter provided to a banknote depositing and dispensing port, a banknote depositing and dispensing section receiving banknote(s) introduced through the banknote depositing and dispensing port when the shutter has been opened, and a pickup roller feeding out the banknote(s) inside the banknote depositing and dispensing section to a conveying path. The banknote depositing and dispensing section includes a banknote guide section that faces a banknote face from the pickup roller side and moves in a direction of the banknote face, the banknote guide section having a cutout at a location facing the pickup roller, a bill press that faces another banknote face opposite to the banknote face facing the banknote guide section and moves in the direction of the banknote face, and an upper guide section that is attached at an upper portion of the banknote guide section, that enters into a gap between the banknote guide section and the shutter, and that moves in the direction of the banknote face. During depositing processing, the banknote guide section and the bill press are separated from each other, such that a banknote accommodation space formed between the banknote guide section and the bill press is positioned below the banknote depositing and dispensing port, the upper guide section is moved towards the pickup roller side and the shutter is opened. After the banknote(s) have been introduced and the shutter has been closed, the upper guide section is moved from the pickup roller side towards the bill press side, and the banknote guide section and the bill press are moved towards the pickup roller side, such that the pickup roller, which is projected out into the accommodation space through the cutout of the banknote guide section and which makes contact with the banknote, feeds the banknote out towards the conveying path.

Effect of the Invention

Accordingly, in the present invention, the banknote depositing and dispensing port and the banknote guide section configuring a wall for forming the banknote accommodation space are disposed at the pickup roller side, and the upper guide section is attached to the upper portion of the banknote guide section. Then, when the input port shutter is open, the upper guide section is moved so as to be positioned projecting out towards the pickup roller side. Accordingly, even if a foreign object was to enter the gap between the input port shutter and the banknote guide section, the foreign object would be prevented from falling into an apparatus by the projecting upper guide section.

Furthermore, when the shutter is closed, in order to move the banknote guide section towards the pickup roller side, by moving the upper guide section to above the banknote accommodation space, the upper guide section is retreated from a position projecting out to the pickup roller side. Consequently, an effect is obtained in that the dimensions of the casing can be made smaller in the pickup roller direction.

BEST MODE OF IMPLEMENTING THE INVENTION

Explanation follows below regarding an exemplary embodiment of a banknote depositing and dispensing machine according to the present invention, with reference to the drawings.

Figure 1:
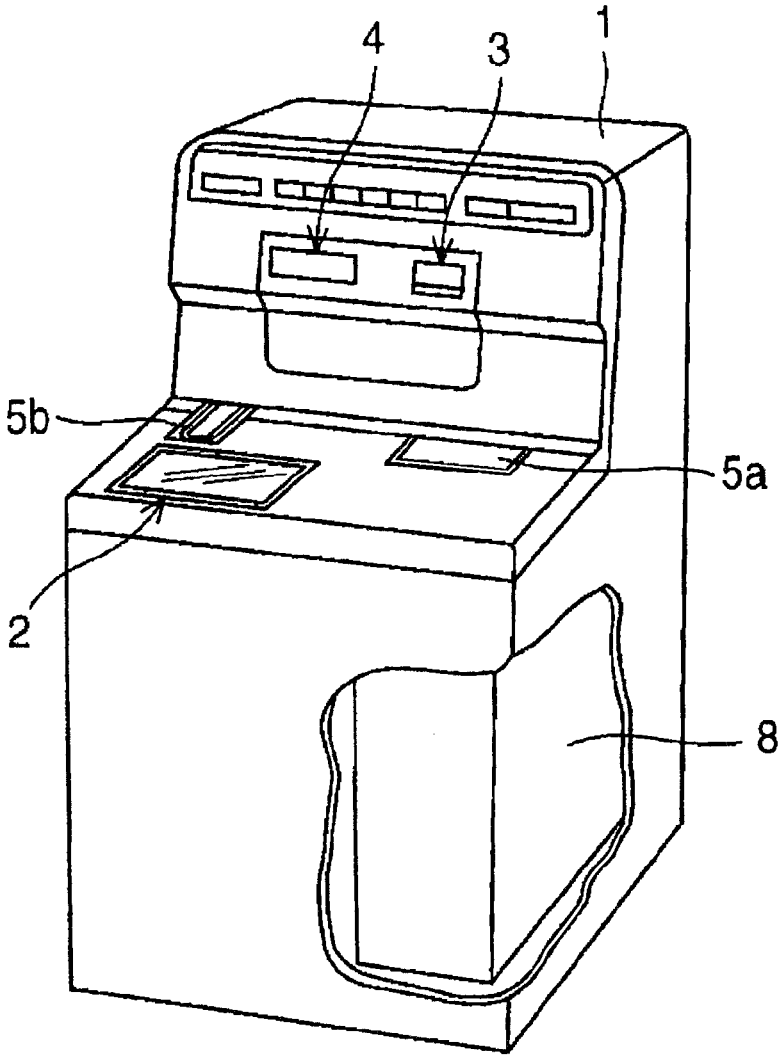
FIG. 1 is an explanatory diagram showing the external appearance of an automated teller machine of a first exemplary embodiment.

FIG. 1 is an explanatory diagram showing the external appearance of an automated teller machine according to a first exemplary embodiment.

In FIG. 1, an automated teller machine 1, serving as a banknote depositing and dispensing machine installed in a branch of a financial institution, such as a bank, or a convenience store or the like, is connected by communication line to a host computer provided in a financial institution center, so as to enable data communication.

The automated teller machine 1 is equipped with a display input section 2, a card read-write section 3, a passbook recording section 4, and a cash depositing and dispensing section 5, and equipped with non-illustrated sections, such as a controller, storage section and the like.

The display input section 2 is provided so as to be exposed at a customer interface on the front face of the automated teller machine 1, and is provided with an input section, such as a touch panel or the like, over a display section, a CRT display or liquid crystal display or the like, having an upward facing display screen.

The automated teller machine 1 displays screens laid out with messages guiding customer operation together with various input keys. Configuration is made such that the designated data for these keys can be input by finger-press on the input keys on the touch panel, and the display section displays input data and the like.

The card read-write section 3 has functionality for reading and writing data to and from a magnetic stripe provided on a customer transaction card, and an insertion and return opening for the cards is provided on the customer interface.

The passbook recording section 4 has functionality for reading and writing data to and from a magnetic stripe provided on a customer passbook, and also functionality for recording transaction contents and the like in the customer passbook. A passbook insertion and return opening is provided on the customer interface.

Since depositing and dispensing of cash is performed during transactions, the cash depositing and dispensing section 5 is configured with a banknote handling section for handing banknotes and a coin handling section for handling coins. As shown in FIG. 1, there is a banknote depositing and dispensing port 5*a* and a coin dispensing port 5*b* provided on the customer interface.

Figure 2:
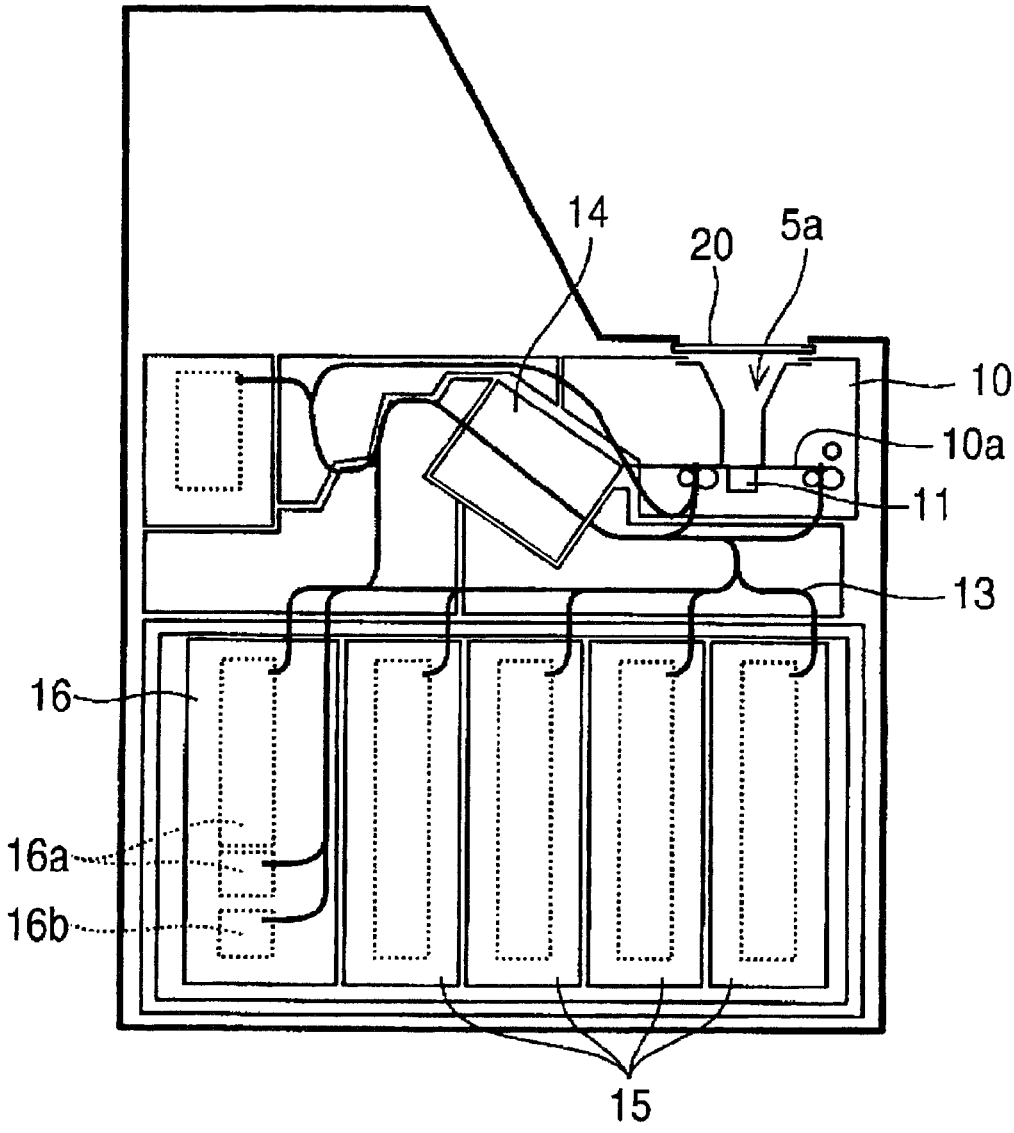
FIG. 2 is an explanatory diagram showing an outline configuration of a banknote handling section.

FIG. 2 is an explanatory diagram showing an outline configuration of a banknote handling section.

In FIG. 2, a banknote depositing and dispensing section 10 has an accommodating space for housing banknotes inserted through the banknote depositing and dispensing port 5*a* in an upright state. A bottom panel 10*a* of this accommodating space, for example a portion thereof, is configured with mesh, and a foreign object holding section 11 is provided below the location of the mesh for collecting and holding any foreign objects, such as clips, dust and the like. Accordingly, configuration is made such that foreign objects introduced with banknotes fall into the foreign object holding section 11 through the mesh of the bottom panel 10*a*, such that any foreign objects are not carried further into a conveying path 13, described later.

The conveying path 13 conveys banknotes fed out from the banknote depositing and dispensing section 10 to each section of the banknote handling section.

A banknote examination section 14 examines the banknotes for their denomination, authenticity, damage characteristics and the like.

A storage section 15 is configured with four stores for storing banknotes of predetermined denominations, and is provided with feed-out means to feed out banknotes stored in each of the stores to the conveying path 13.

A banknote collection section 16 is a unit configured with a banknote top-up and collection store 16*a* for storing banknotes for topping up the storage section 15 and banknotes collected from each of the stores, and a dispensing reject store 16*b* for stacking banknotes diagnosed as being reject banknotes by the banknote examination section 14.

Figure 3:
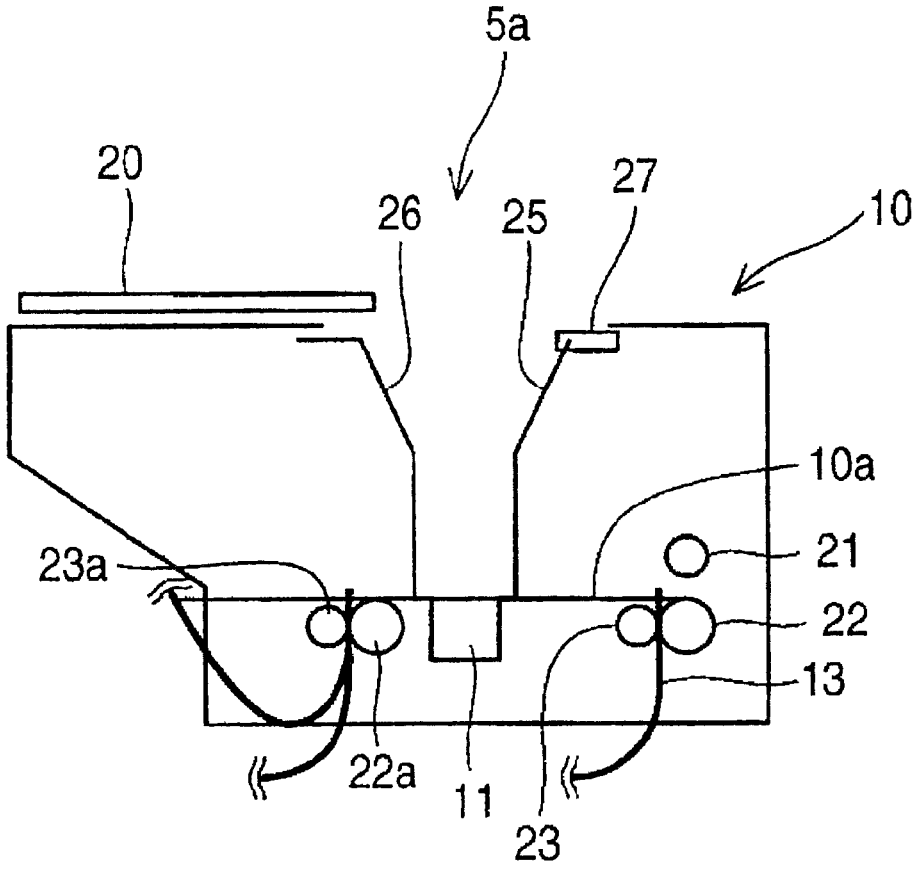
FIG. 3 is an explanatory diagram showing a banknote depositing and dispensing section.

FIG. 3 is an explanatory diagram showing a banknote depositing and dispensing section.

In FIG. 3, an input port shutter 20 is a sliding shutter disposed at an upper portion of the banknote accommodating space described above. The input port shutter 20 is configured so as to be moveable to-and-fro along a direction perpendicular to the face of banknotes housed in an upright state in the banknote depositing and dispensing section 10. The input port shutter 20 opens the banknote depositing and dispensing port 5*a* during banknote depositing and during banknote introduction or banknote removal, and closes off the banknote depositing and dispensing port 5*a*, for example during intake processing or the like, taking in the banknotes inside the banknote depositing and dispensing section 10.

There is a sensor, not shown in the drawings, provided in the vicinity of the input port shutter 20, such as an infrared sensor or the like. The hand of a customer inserted into the banknote depositing and dispensing port 5*a* is detected by blocking of this sensor.

A pickup roller 21 at the side of the banknote depositing and dispensing section 10 shown in FIG. 3 has functionality for feeding out a banknote held upright on the bottom panel 10*a*.

A feed roller 22 is configured so as to be rotatable in a forward direction by a drive source, not shown in the drawings, and the feed roller 22 is disposed at an end portion of the bottom panel 10*a* downstream of the pickup roller 21 in the banknote feed-out direction. The feed roller 22 has functionality to combine with the pickup roller 21 in feeding out a banknote onto the conveying path 13.

Note that the pickup roller 21 and the feed roller 22 are connected by a drive transfer mechanism, not shown in the drawings, such as gears or the like. The pickup roller 21 is coupled to the feed roller 22, and rotates in the same direction as the feed roller 22 rotates.

A gate roller 23 is disposed so as to face the feed roller 22, and has functionality for cooperating with the feed roller 22 during banknote feeding so as to separate banknotes into single notes.

Such functionality for separating the banknotes into single notes is, for example, realized by a configuration in which two ring shaped groove portions are provided side by side at a section of the outer peripheral face of the feed roller 22 side around the entire circumferential direction of the outer peripheral face and are mounted with a high friction member having sufficient friction force to convey a banknote. Further, a single ring shaped projection portion is provided on the outer peripheral face of the gate roller 23 side around the circumferential direction of the outer peripheral face, such that the groove portions of the feed roller 22 and the projection portion on the gate roller 23 mesh together.

An import feed roll 22*a* is provided on the side opposite to the feed roller 22, with the foreign object holding section 11 interposed therebetween. The import feed roll 22*a* imports arriving banknotes, that have been fed out from the storage section 15 and conveyed by the conveying path 13, into the banknote depositing and dispensing section 10, during dispensing processing or the like.

An import gate roller 23*a* is disposed facing the import feed roll 22*a*. The import gate roller 23*a* separates banknotes into single sheets when, for example, banknotes have been conveyed overlapping with each other during importing.

A banknote guide section 25 is a wall disposed to configure a banknote accommodation space on the pickup roller 21 side, facing the banknote face. The banknote guide section 25 is configured so as to be movable to-and-fro in a direction towards the banknote face direction, and is provided with a cutout portion. In order to feed out banknotes inside the accommodation space, the outer peripheral face of the pickup roller 21 is moved through the cutout portion to a position protruding out into the accommodation space.

A bill press 26 is a wall disposed to configure the banknote accommodation space at a position facing the banknote guide section 25. The bill press 26 is configured so as to be moveable to-and-fro in a direction towards the banknote face direction, and is moved together with the banknote guide section 25 towards the pickup roller 21 side when feeding out banknotes, thereby operating to press the banknotes against the pickup roller 21.

Note that, in order to facilitate a customer introducing the banknotes, the faces of the banknote guide section 25 and the bill press 26 facing the banknotes are inclined faces that incline inwards towards the banknote accommodation space from an upper portion of the faces down to a central portion, with portions below the inclined faces configured by vertical faces.

Since the pickup roller 21 is provided in a position corresponding to the vertical face of the banknote guide section 25, the cutout provided to the banknote guide section 25 is formed in the vertical face.

In order to insert a upper guide section 27 into a gap between the banknote guide section 25 and the casing of the automated teller machine 1, the upper guide section 27 is attached to an upper portion of the banknote guide section 25, and configuration is made such that the upper guide section 27 is configured movable in a direction towards the banknote face using a drive mechanism, not shown in the drawings.

As shown in FIG. 3, any foreign objects during banknote introduction are prevented from being drawn inside through the gap between the banknote guide section 25 and the casing of the automated teller machine 1 by positioning the upper guide section 27 so as to project out to the pickup roller 21 side when the banknote guide section 25 and the bill press 26 are below the banknote depositing and dispensing port 5*a*.

Explanation now follows of operation of the above configuration.

Operation of each portion as explained below is operation controlled by a controller, not shown in the drawings, according to a program (software) stored on a storage section, not shown in the drawings.

During depositing transactions, the banknote guide section 25 and the bill press 26 are disposed below the banknote depositing and dispensing port 5*a*, separated from each other by a specific separation such that the accommodation space is configured narrower in width than the opening of the banknote depositing and dispensing port 5*a*, and of a size about that of an inserted hand of a customer.

The upper guide section 27 is also moved towards the pickup roller 21 side on such occasions.

Opening the banknote depositing and dispensing port 5*a* with opening operation of the input port shutter 20 then enables a customer to introduce banknotes through the banknote depositing and dispensing port 5*a*.

Closing operation of the input port shutter 20 is performed after a specific duration has elapsed from when the hand of the customer introducing the banknotes has last been detected by a sensor, not shown in the drawings.

Figure 4:
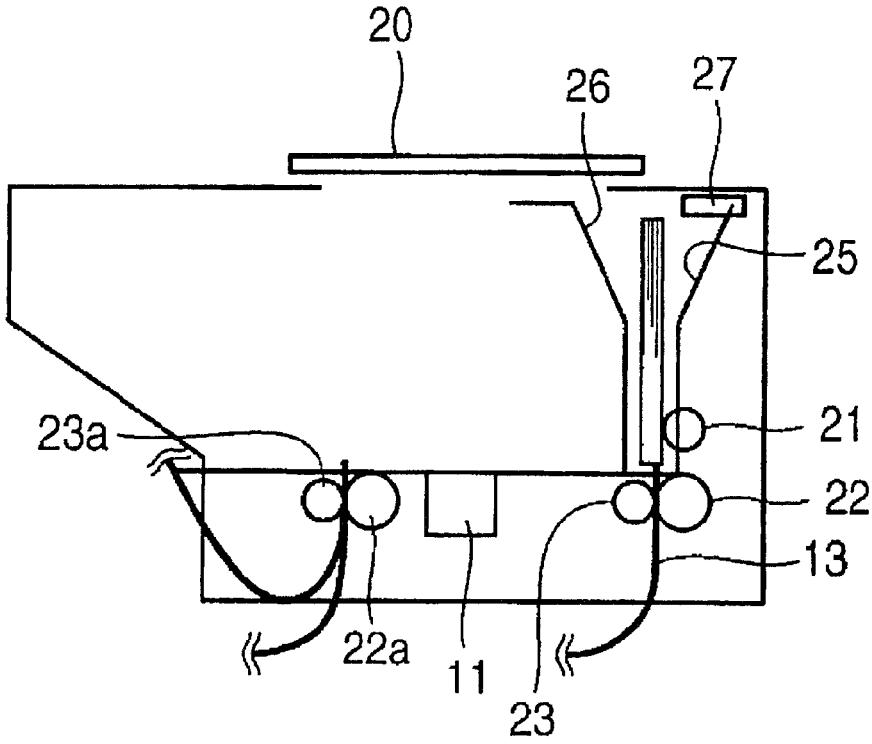
FIG. 4 is an explanatory diagram showing a banknote handling section performing banknote feeding out operation.

FIG. 4 is an explanatory diagram showing a banknote handling section performing a banknote feeding operation.

After shutting the input port shutter 20, in order to separate the accommodated banknotes and perform feeding operation, the bill press 26 is moved towards the banknote guide section 25 side, so as to hold the banknotes in the accommodation space in an upright state between the banknote guide section 25 and the bill press 26. The banknote guide section 25 and the bill press 26 are moved towards the pickup roller 21 side while maintaining this state. Thereby, as shown in FIG. 4, the pickup roller 21 projects out into the accommodation space through the cutout in the banknote guide section 25, making contact with the banknotes housed in an upright state in the accommodation space.

Matching closing of the input port shutter 20, the upper guide section 27 attached to the upper portion of the banknote guide section 25 moves from the pickup roller 21 side towards the bill press 26 side, namely moves to above the accommodation space.

Then, by rotating the pickup roller 21 and the feed roller 22 in the feed direction, the banknote making contact with the pickup roller 21 is fed out between the feed roller 22 and the gate roller 23. Furthermore, banknotes between the feed roller 22 and the gate roller 23 are separated into single notes and fed out to the conveying path 13. The banknote that has been fed out is subjected to banknote examination by the above banknote examination section 14, and stored in the respective store of the storage section 15 according to the examination result, thereby performing depositing processing.

Note that, during dispensing processing and the like, when banknotes are fed out from the storage section 15 and conveyed by the conveying path 13, the banknote guide section 25 is placed at the right hand side of the import feed roll 22*a* and the bill press 26 is placed at the left hand side of the import gate roller 23*a* in advance of the banknotes arriving for drawing into the banknote depositing and dispensing section 10. Accordingly, the banknote accommodation space is configured above the import feed roll 22*a* and the import gate roller 23*a*, so that banknotes are drawn into this accommodation space.

In the present exemplary embodiment as explained above, the banknote depositing and dispensing port and the banknote guide section configuring a wall for forming the banknote accommodation space are disposed at the pickup roller side, and the upper guide section is attached to the upper portion of the banknote guide section. Then, when the input port shutter is opened, the upper guide section is moved so as to be positioned projecting out towards the pickup roller side. Accordingly, even if a foreign object was to enter the gap between the input port shutter and the banknote guide section, the foreign object would be prevented from falling into the apparatus by the projecting upper guide section.

Furthermore, when the input port shutter is closed and the banknote guide section is moved to the pickup roller side, the upper guide section is moved over the banknote accommodation space. The upper guide section is thereby retreated from a position projecting out to the pickup roller side, and the dimension of the casing in the pickup roller direction can be made smaller.

This enables a configuration to be achieved in which the banknote depositing and dispensing port and the input port shutter are made nearer to the side of the customer, raising customer convenience.

The guiding section and the bill press are configured so as to be movable together, to move banknotes in the accommodation space above the feed roller and the gate roller during depositing processing. However, during dispensing processing, the banknote guide section and the bill press are moved so as to form the accommodation space above the import feed roller and the import gate roller. Due to such a configuration, it is not required any longer to set the disposition of the feed roller and the gate roller, and the import feed roller and the import gate roller, to match the size of the accommodation space, as in a conventional automated teller machine with fixed banknote accommodation space, and an effect is obtained of increasing the degrees of freedom of design for the banknote depositing and dispensing machine.

Note that there is no limitation to a single upper guide section provided to the upper portion of the banknote guide section, and configuration may be made with plural provided, and the number of upper guide sections and the size of the upper guide section(s) themselves may be set according to the size of the banknote depositing and dispensing port and the like.

Furthermore, configuration is made such that the upper guide section is immobilized in a state in which the input port shutter is open and banknote introduction into the banknote depositing and dispensing port is possible, and the upper guide section is mobilized when the input port shutter is in a closed state. Configuration may be made in which the upper guide section and the input port shutter are then moved, coupled together, so that the upper guide section is positioned above the accommodation space, in order to prevent the upper guide section from being positioned above the accommodation space during banknote introduction and obstructing banknote introduction.

Second Exemplary Embodiment

Figure 5:
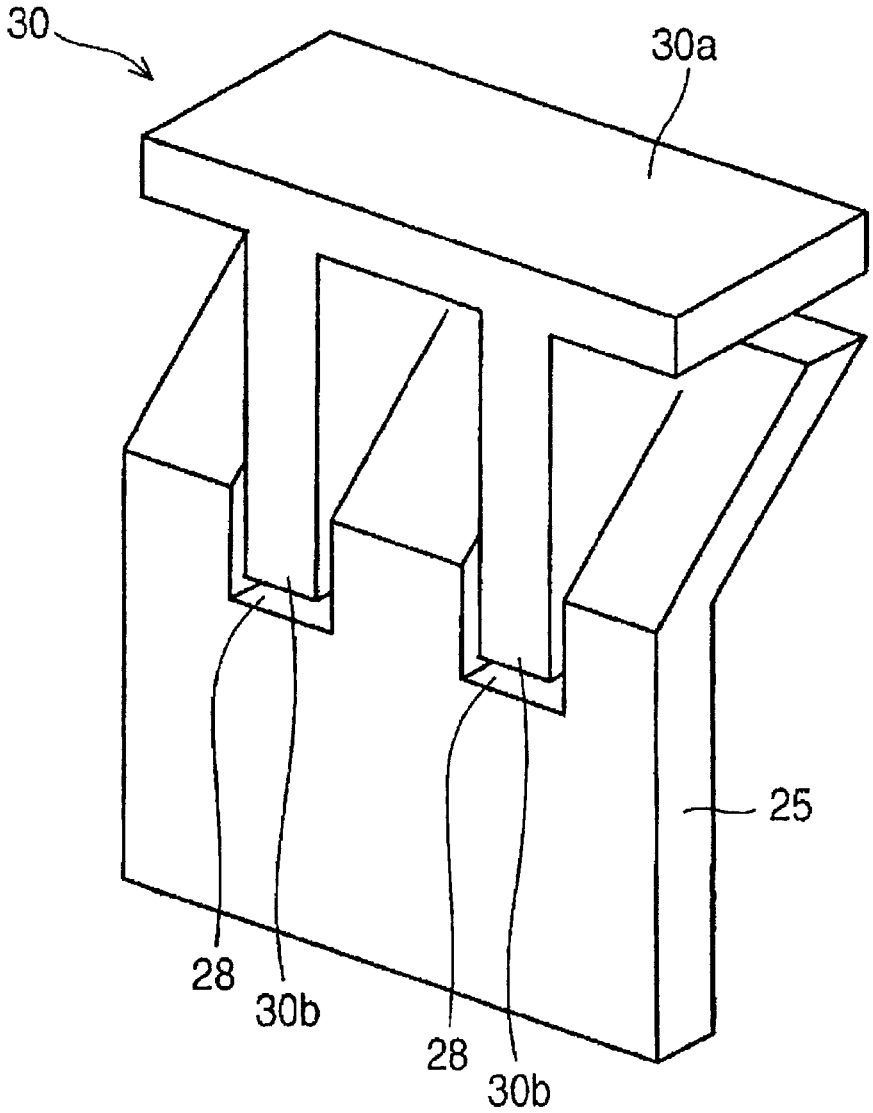
FIG. 5 is an explanatory diagram showing an upper guide section of a second exemplary embodiment.

FIG. 5 is an explanatory diagram showing an upper guide section of a second exemplary embodiment.

Note that portions similar to those of the above first exemplary embodiment are allocated the same reference numerals and further explanation is omitted.

In FIG. 5, in addition to the configuration of the above first exemplary embodiment, the banknote guide section 25 of the present exemplary embodiment is provided with vertical cutout portions 28 from the top edge partway downwards (to a substantially central position) at portions of the inclined face.

An upper guide section 30 is configured in the second exemplary embodiment with a top plate 30*a* and guide projection portions 30*b* that extend downwards from the top plate 30*a*, each of the guide projection portions 30*b* having a vertical face facing the bill press 26 when the guide projection portions 30*b* are in a nested state in the cutout portions 28 of the banknote guide section 25. The upper guide section 30 is then, similarly to in the first exemplary embodiment, configured to be movable in a direction towards the banknote face by a drive mechanism, not shown in the drawings.

Explanation now follows regarding operation of the above configuration.

Figure 6:
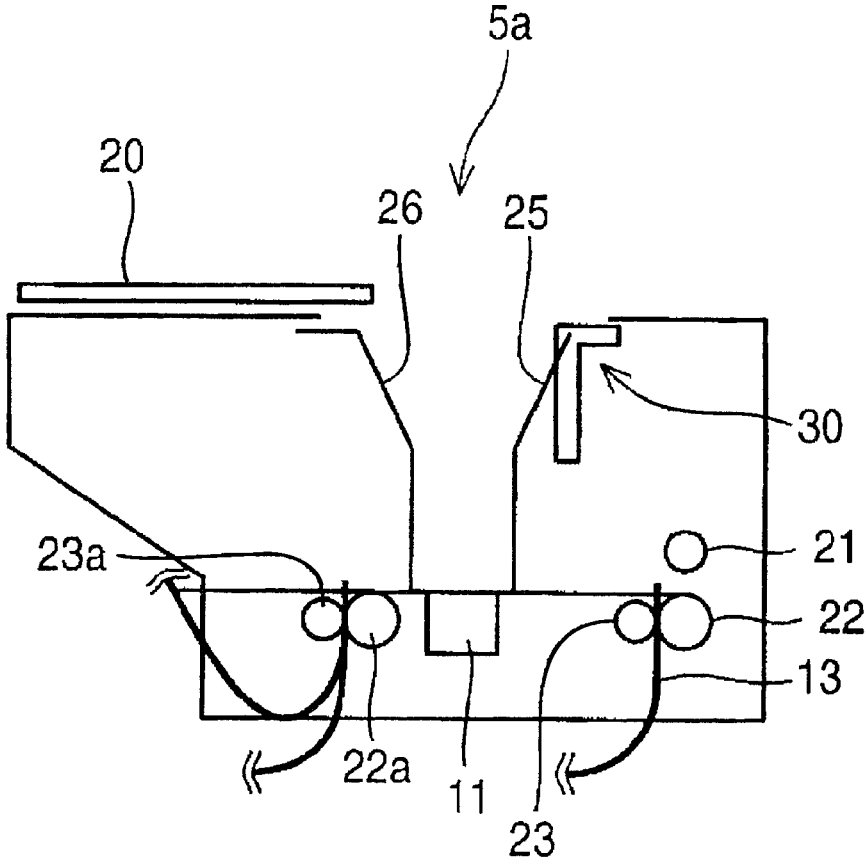
FIG. 6 is an explanatory diagram showing a banknote depositing and dispensing port of the second exemplary embodiment during banknote insertion.
Figure 7:
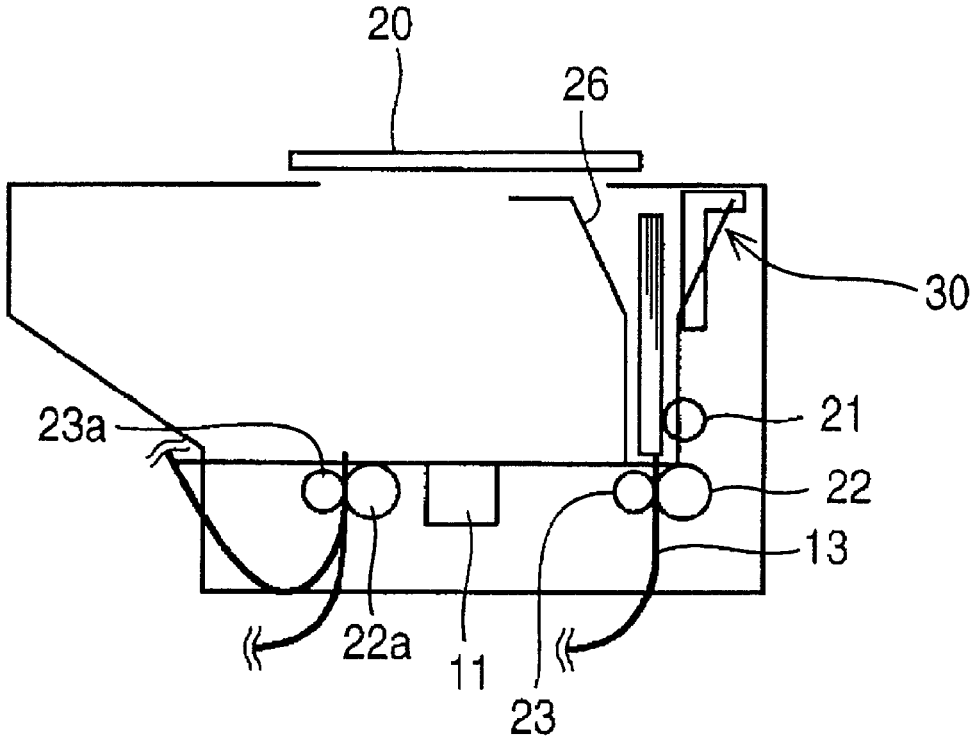
FIG. 7 is an explanatory diagram showing a banknote depositing and dispensing port of the second exemplary embodiment during banknote feeding out.

FIG. 6 is an explanatory diagram showing a banknote depositing and dispensing port of the second exemplary embodiment during banknote insertion, FIG. 7 is an explanatory diagram showing a banknote depositing and dispensing port of the second exemplary embodiment during banknote feeding out.

Operation of each section as explained below is operation controlled by a controller, not shown in the drawings, according to a program (software) stored on a storage section, not shown in the drawings.

As shown in FIG. 6, when performing a depositing transaction the banknote guide section 25 and the bill press 26 below the banknote depositing and dispensing port 5*a* are positioned so as to configure an accommodation space narrower in width than the opening of the banknote depositing and dispensing port 5*a* and about the entry size of the hand of a customer gripping the banknotes.

The banknote depositing and dispensing port 5*a* is then opened by the opening operation of the input port shutter 20 and a customer introduces banknotes through the banknote depositing and dispensing port 5*a*.

Closing operation of the input port shutter 20 is performed after a specific duration has elapsed from when the hand of the customer introducing the banknotes has last been detected by a sensor, not shown in the drawings, thereby closing off the banknote depositing and dispensing port 5*a*.

After closing the input port shutter 20, in order to separate the accommodated banknotes and perform feeding operation, the bill press 26 is moved towards the banknote guide section 25 side. The banknotes in the accommodation space are held by the banknote guide section 25 and the bill press 26 in an upright state. The banknote guide section 25 and the bill press 26 are then moved towards the pickup roller 21 side, while this state is maintained. Thereby, as shown in FIG. 7, the pickup roller 21 is projected out into the accommodation space through the cutout in the banknote guide section 25, making contact with the banknotes housed in an upright state in the accommodation space.

As this is performed, the upper guide section 30 attached to an upper portion of the banknote guide section 25 moves towards the bill press 26 side, namely moves so as to enter into the accommodation space. Accordingly, the guide projection portions 30*b* are moved to a position where they are in substantially the same plane as the vertical face of the banknote guide section 25.

By rotation of the pickup roller 21 and the feed roller 22 in the feed out direction, the banknote making contact with the pickup roller 21 is fed out between the feed roller 22 and the gate roller 23. Banknotes between the feed roller 22 and the gate roller 23 are also separated into single notes and fed out to the conveying path.

In the present exemplary embodiment as explained above, in addition to the effects of the first exemplary embodiment, the upper guide section is configured by the upper plate and the guide projection portions, with vertical faces for the faces on the guide projection portions facing the bill press. Accordingly, when the upper guide section is moved towards the inside of the accommodation space in order to feed out the banknotes, the guide projection portions configure the same plane as the vertical face portions of the banknote guide section, and hence the guide projection portion perform the role of guides for conveying the banknotes in the feed out direction. Consequently, the faces of the banknote being fed out can be supported, and feeding out of the banknotes can be performed in the stable state.

EXPLANATION OF THE REFERENCE NUMERALS

1 automated teller machine
2 display input section

3 card read-write section
4 passbook recording section
5 cash depositing and dispensing section
5*a* banknote depositing and dispensing port
5*b* coin dispensing port
10 banknote depositing and dispensing section
10*a* bottom panel
11 foreign object holding section
13 conveying path
14 banknote examination section
15 storage section
16 banknote collection section
16*a* banknote top-up and collection store
16*b* dispensing reject store
20 input port shutter
21 pickup roller
22 feed roller
22*a* import feed roll
23 gate roller
23*a* import gate roller
25 banknote guide section
26 bill press
27, 30 upper guide section
28 cutout portion
30*a* top plate
30*b* guide projection portions

The invention claimed is:

1. A banknote depositing and dispensing machine, comprising:

a shutter provided at a banknote depositing and dispensing port;

a banknote depositing and dispensing section which receives banknote(s) introduced through the banknote depositing and dispensing port when the shutter has been opened, and being movable between a first position and a second position; and a pickup roller, wherein the banknote depositing and dispensing section includes a banknote guide section that faces a first face of a banknote from a pickup roller side of the banknote depositing and dispensing section and being movable to the first position and the second position, the banknote guide section having a cutout at a location facing the pickup roller, a bill press that faces a second face of the banknote which is opposite to the first face, and being movable to the first position and the second position, said bill press being movable both independently of, and together with a movement of the banknote guide section, the bill press and banknote guide section defining an accommodation space therebetween for receiving the banknote(s), the accommodation space being in communication with a conveying path when said banknote depositing and dispensing section is at the second position, the accommodation space changing size when the bill press moves independently of the banknote guide section, and an upper guide section that is arranged over an upper portion of the banknote guide section and being movable so as to be substantially non-overlapping over the accommodation space when said banknote depositing and dispensing section is at the first position, and being movable so as to be substantially overlapping over the accommodation space when said the banknote depositing and dispensing section is at the second position, and the pickup roller feeds out the banknote(s) inside the accommodation space to the conveying path when the banknote depositing and dispensing section is at the second position.

2. The banknote depositing and dispensing machine according claim 1, wherein the upper guide section includes a guide portion that serves as a guide for conveying the banknotes in a feed out direction when the upper guide section is moved to the second position.

3. The banknote depositing and dispensing machine according to claim 1, wherein the banknote guide section has an inclined face extending from a top edge of the banknote guide section downwards, with a vertically extending cutout being provided in the inclined face, and the upper guide section includes a guide projection portion that fits in a nested state in the cutout, has a vertical face that faces the bill press, and that makes contact the banknote when the upper guide section is moved to the second position, and a top plate that is attached to an upper portion of the guide projection portion, and that enters into a gap between the banknote guide section and the shutter.

4. A banknote depositing and dispensing machine, comprising:

a shutter provided at a banknote depositing and dispensing port;

a banknote depositing and dispensing section receiving banknote(s) introduced through the banknote depositing and dispensing port when the shutter has been openend; and a pickup roller feeding out the banknote(s) inside the banknote depositing and dispensing section to a conveying path, wherein the banknote depositing and dispensing section comprises:

a banknote guide section that faces a banknote face from a pickup roller side, and that moves in a direction towards the banknote face, the banknote guide section having a cutout at a location facing the pickup roller, and the banknote guide section being formed with an inclined face from a top edge of the banknote guide section partway downwards, with a cutout provided at a portion of the inclined face in a vertical direction;

a bill press that faces another banknote face opposite to the banknote face facing the banknote guide section and moves in the direction towards the banknote face; and an upper guide section that is attached at an upper portion of the banknote guide section, that enters into a gap between the banknote guide section and the shutter, and that moves in the direction towards the banknote face, the upper guide section including a guide projection portion that fits in a nested state in the cutout, has a vertical face that faces the bill press, and makes contact with the banknote face when the upper guide section is moved to the bill press side, and a top plate that is attached to an upper portion of the guide projection portion and enters into the gap between the banknote guide section and the shutter, wherein during depositing processing, the banknote guide section and the bill press are separated from each other, such that a banknote accommodation space formed between the banknote guide section and the bill press is positioned below the banknote depositing and dispensing port, the upper guide section is moved towards the pickup roller side and the shutter is opened, and after the banknote(s) have been introduced and the shutter has been closed, the upper guide section is moved from the pickup roller side towards the bill press side, and the banknote guide section and the bill press are moved towards the pickup roller side, such that the pickup roller, which is projected out into the accommodation space through the cutout of the banknote guide section and which makes contact with the banknote, feeds the banknote out towards the conveying path.

5. A banknote depositing and dispensing machine, comprising:

a shutter provided at a banknote depositing and dispensing port;

a banknote depositing and dispensing section which receives banknote(s) introduced through the banknote depositing and dispensing port when the shutter has been opened during a depositing processing, and being movable to a further position for a dispensing processing; and a pickup roller which feeds out the banknote(s) inside the banknote depositing and dispensing section to a conveying path, wherein the banknote depositing and dispensing section includes a banknote guide section that faces a first face of a banknote from a pickup roller side of the banknote depositing and dispensing section, and that moves in a first direction substantially perpendicular to the banknote faces, the banknote guide section having a cutout at a location facing the pickup roller, a bill press that faces a second face of the banknote which is opposite to the first face, and that moves in the first direction, and an upper guide section that is arranged over an upper portion of the banknote guide section, that enters into a gap between the banknote guide section and the shutter during the depositing processing, and that includes a guide portion that serves as a guide for conveying the banknote in a feed out direction when the banknote guide section is moved to the further position during the dispensing processing, and wherein during the depositing processing, the banknote guide section and the bill press are separated from each other to define a banknote accommodation space formed between the banknote guide section and the bill press and which is positioned below the banknote depositing and dispensing port, the upper guide section is positioned towards the pickup roller side, and the shutter opens, and after the banknote(s) have been introduced and the shutter has been closed, the upper guide section is moved from the pickup roller side towards the bill press side, and the banknote guide section and the bill press are moved towards the pickup roller side during the dispensing processing, such that the guide portion contacts the banknote, and the pickup roller projects out into the accommodation space through the cutout, and contacts the banknote to feed the banknote out towards the conveying path.

* * * * *